US008601726B2

(12) United States Patent
Mayer et al.

(10) Patent No.: US 8,601,726 B2
(45) Date of Patent: Dec. 10, 2013

(54) THREE DIMENSIONAL FOAM GREETING CARD

(75) Inventors: David Mayer, Bay Village, OH (US); Lauren M. Budzar, Seven Hills, OH (US); Eva Jin, Shanghai (CN); Mary McClain, Shaker Heights, OH (US)

(73) Assignee: American Greetings Corporation, Cleveland, OH (US)

( * ) Notice: Subject to any disclaimer, the term of this patent is extended or adjusted under 35 U.S.C. 154(b) by 120 days.

(21) Appl. No.: 13/313,146

(22) Filed: Dec. 7, 2011

(65) Prior Publication Data

US 2012/0304509 A1 Dec. 6, 2012

Related U.S. Application Data

(63) Continuation-in-part of application No. 13/004,544, filed on Jan. 11, 2011, now Pat. No. 8,205,365.

(51) Int. Cl.
*G09G 1/00* (2006.01)

(52) U.S. Cl.
USPC ..... 40/124.01; 40/124.03; 40/406; 40/409

(58) Field of Classification Search
USPC ..... 40/124.01, 124.03, 406, 409
See application file for complete search history.

(56) References Cited

U.S. PATENT DOCUMENTS

| | | | | |
|---|---|---|---|---|
| 2,927,400 | A | 3/1960 | Bailey | |
| 3,191,340 | A * | 6/1965 | Jacobson et al. | 446/149 |
| 4,870,764 | A | 10/1989 | Boone | |
| 5,195,918 | A * | 3/1993 | Mozes | 446/227 |
| 5,303,487 | A | 4/1994 | Olson | |
| 5,671,555 | A * | 9/1997 | Fernandes | 40/124.03 |
| 5,743,035 | A | 4/1998 | Bradley et al. | |
| 6,282,819 | B1 * | 9/2001 | Gu | 40/124.03 |
| 6,357,152 | B1 | 3/2002 | Brooks et al. | |
| 6,460,277 | B1 | 10/2002 | Tower | |
| 6,484,425 | B1 * | 11/2002 | Hirsch | 40/406 |
| 6,848,965 | B2 | 2/2005 | Wong | |
| 7,201,402 | B2 | 4/2007 | Duprey | |
| 7,322,134 | B2 | 1/2008 | Cheek et al. | |
| 7,634,864 | B2 | 12/2009 | Segan | |
| 2008/0032587 | A1 | 2/2008 | Krivanek et al. | |
| 2009/0126239 | A1 | 5/2009 | Clegg | |
| 2009/0241387 | A1 | 10/2009 | Wong | |
| 2012/0110879 | A1 | 5/2012 | Qiao et al. | |

FOREIGN PATENT DOCUMENTS

| | | |
|---|---|---|
| NL | 1033961 | 12/2007 |
| WO | WO 8502376 A1 * | 6/1985 |

* cited by examiner

*Primary Examiner* — Casandra Davis
(74) *Attorney, Agent, or Firm* — Christine A. Flanagan

(57) ABSTRACT

Three-dimensional lightweight foam greeting cards are described herein having a foam body with a perimeter wall that extends between two spaced apart parallel pieces of planar sheet material such as heavy gauge paper, cardboard, or other such material. The greeting cards have a partially hollowed foam body or one or more cavities in the foam body concealed in the front and back by the planar sheet material which may be pre-cut in the shape of the foam body are decorated consistent with the design of the foam body. The cavities in the foam body may contain various electronic components that enable the greeting card to produce sound, record and playback a personalized message, trigger light activation, trigger the movement of moveable parts, display digital video, photographs or slideshows, or a combination thereof.

19 Claims, 10 Drawing Sheets

THREE DIMENSIONAL FOAM GREETING CARD

RELATED APPLICATIONS

This patent application claims priority to and is a continuation-in-part of U.S. patent application Ser. No. 13/004,544, filed Jan. 11, 2011 now U.S. Pat. No. 8,205,365 and entitled, "Three Dimensional Foam Greeting Cards". The aforementioned United States Patent Application is incorporated by reference herein in its entirety.

FIELD OF THE INVENTION

The present invention relates to greeting cards, and more specifically to three-dimensional foam greeting cards and decorative greeting card accessories.

BACKGROUND OF THE INVENTION

For many years paper greeting cards have been widely used for celebratory occasions such as birthdays, graduations, weddings and other commercial purposes. Traditional text information is generally found on paper greeting cards. More recently, sound has been added to traditional paper greeting cards to increase the personalization of the cards by delivering an audio message that is electronically embodied in circuitry that is carried within the greeting card. The ability to use sound in combination with printed matter such as with conventional printed greeting cards significantly enhances the communicative value of social and relational greetings. The availability of small voice recording sound modules has made sound-generating greeting cards increasingly popular. Small lighting systems have also been incorporated into social greeting products and novelties, and combined in circuits with sound and other features.

SUMMARY OF THE INVENTION

A three-dimensional foam greeting card is described herein, in one embodiment, having a three-dimensional foam body, a first planar surface material attached to a front surface of the three-dimensional foam body, a second planar surface material attached to a back surface of the three-dimensional foam body and a sound module located in a recess in the three-dimensional foam body and concealed by the first and second planar surface material. The sound module may include a speaker, circuit board, integrated circuit, microprocessor, memory device, power source, at least one switch mechanism and at least one pre-loaded digital audio file. The at least one switch mechanism controls playback of the at least one pre-loaded digital audio file.

In another embodiment, the three-dimensional foam greeting card of the present invention contains a three-dimensional foam body having at least one hollowed out portion creating a cavity therein, a first planar surface attached to a front surface of the three-dimensional foam body, a second planar surface attached to a back surface of the three-dimensional foam body, a sound module comprising a speaker, circuit board, integrated circuit, microprocessor, power source, memory device and at least one pre-loaded audio file, a recording device, a first switch to initiate a user recording session, and a second switch to initiate playback of the at least one pre-loaded audio file or a user recorded message.

In still another embodiment, the foam greeting card contains a three-dimensional foam body with a perimeter wall which extends between two spaced apart parallel pieces of heavy gauge planar sheet material, and a multimedia player device located and concealed within the three-dimensional foam body. The multimedia player device may include a circuit board, integrated circuit, microprocessor, speaker, power source, memory device, an electronic display screen operative to display digitally generated images, a data storage device, at least one switch mechanism, and at least one pre-loaded digital audio or video file. The electronic display screen is visible through an opening in the three-dimensional foam body and one of the pieces of heavy gauge planar sheet material.

DETAILED DESCRIPTION OF PREFERRED AND ALTERNATE EMBODIMENTS

The present disclosure and related inventions provide foam constructs in the form of greeting devices, greeting cards, novelties, gifts and foam constructs with functional features, and which can be used in connection with other devices such as retail displays.

Figure 3:
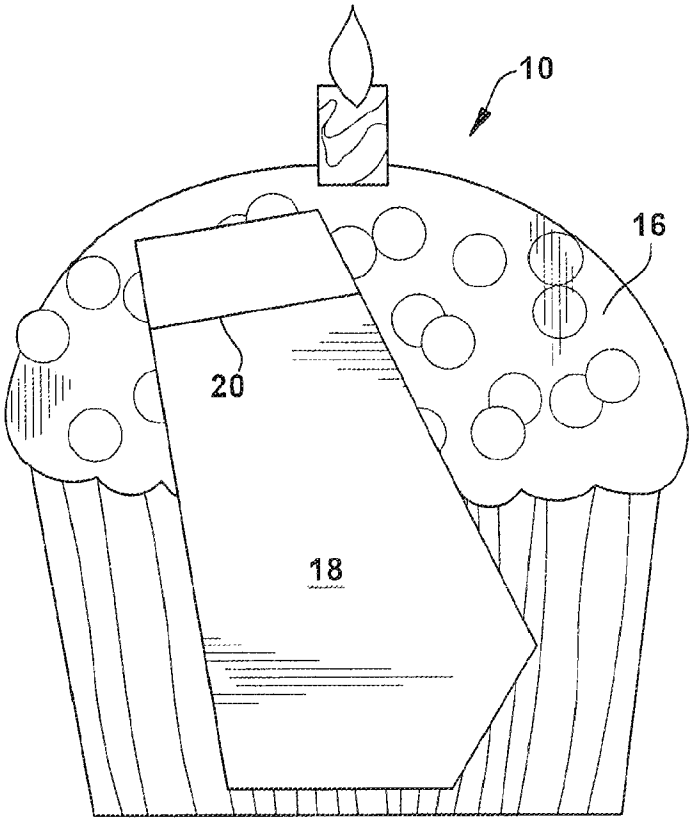
FIG. 3 is a rear view of the three-dimensional foam greeting card of FIG. 1.
Figure 2:
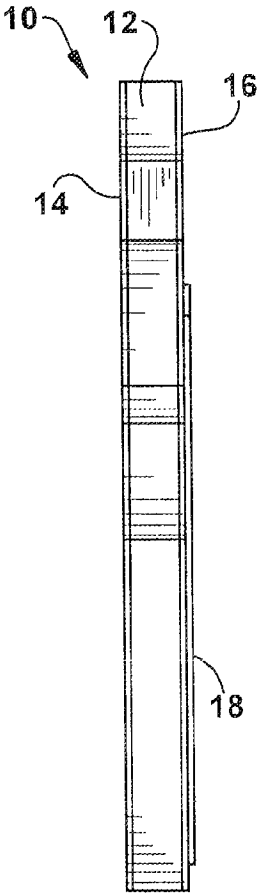
FIG. 2 is a side view of the three-dimensional foam greeting card of FIG. 1.
Figure 9:
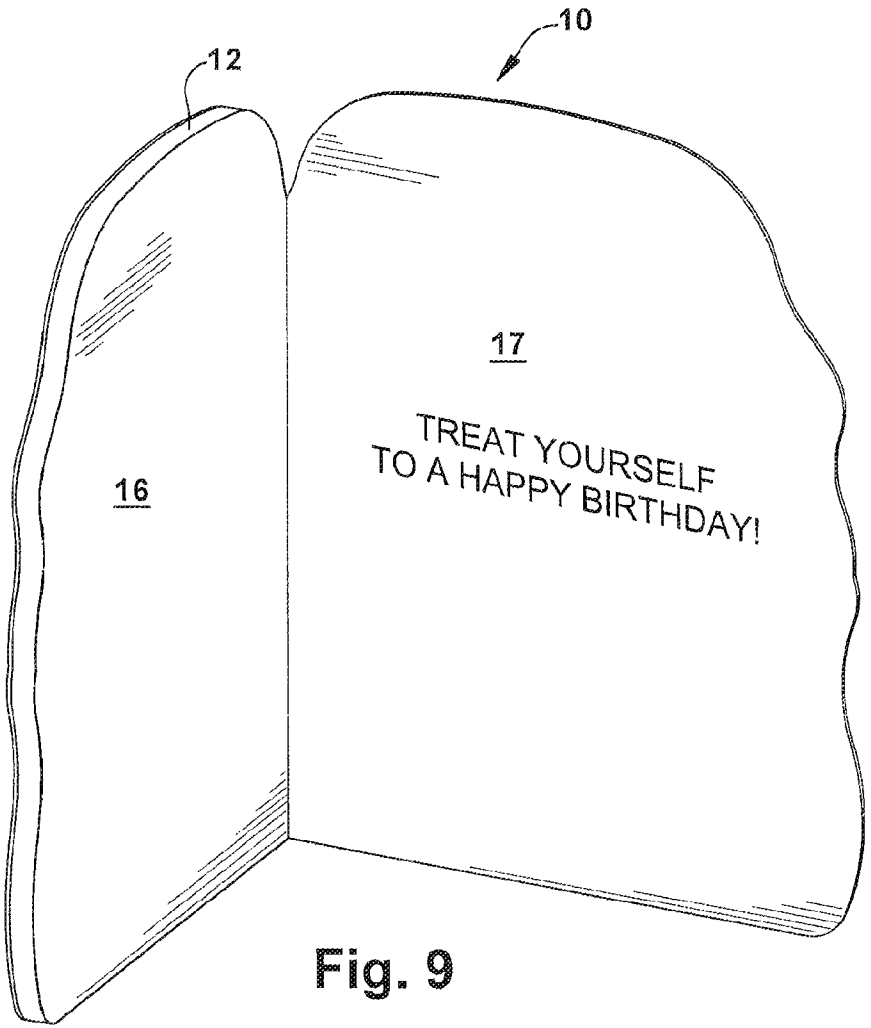
FIG. 9 is a perspective view of the three-dimensional foam greeting card of FIG. 8 in an open position.
Figure 8:
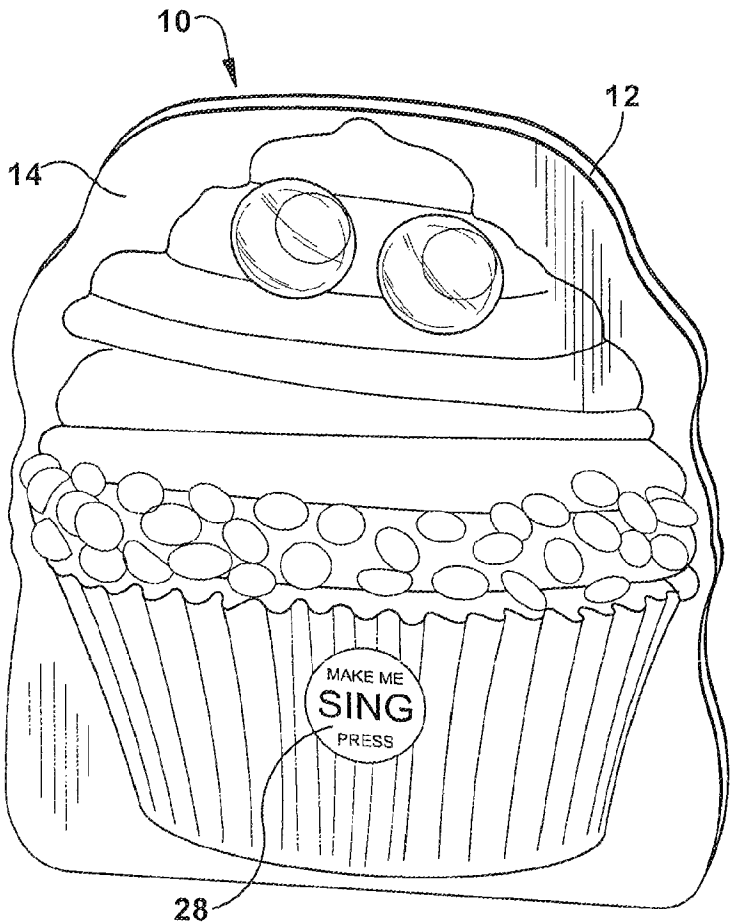
FIG. 8 is a front view of an alternate embodiment of the three-dimensional foam greeting card of the present invention in a closed position.

In one form, a three-dimensional foam greeting card according to the present invention contains a foam body made of a hardened foam or foam-like material which makes the greeting card very lightweight. A representative example is shown in FIGS. 1-4. The foam body 12 of the greeting card 10 can be formed into any shape or profile, examples of which include, but are not limited to: a circle, a cupcake, a candle, an animal, a person, a baby carriage, a Christmas tree, a pumpkin, or any other conceivable shape. Or the greeting card 10 may take on a square or rectangular shape of a traditional greeting card. A portion of the foam body 12 is hollowed out to accommodate a device, examples of which include, but are not limited to: a sound module (shown in FIG. 4), a light module, a motor module, a multimedia player device or any combination thereof. There may be multiple cavities formed in the foam body 12 to receive multiple devices or device components such as batteries, switches, circuit boards, speakers, motors, recording devices, etc. The front and back surfaces of the foam body 12 are generally planar and can be covered with a heavy gauge paper-like material such as paper, cardboard, cardstock, or any other sheet or planar material. The outer paper-like surface 14, 16 can be cut in the shape of the foam body 12 and pre-printed with a design consistent with the shape of the foam body 12. The front surface 14 may bear decoration consistent with a front view of the item and the back surface 16 may contain decoration consistent with the back view of the item. For example, if the foam body and outer cover contain the shape and decoration of a dog, the front cover of the foam greeting card may contain the right side profile of the dog and the back cover may contain the left side profile of the dog. The outer surfaces 14, 16 are adhesively or otherwise attached to the foam body 12. The greeting card 10 may contain, in addition to the three-dimensional foam body 12 with planar front 14 and back 16 surfaces, a sentiment panel 17, which may be connected to the planar sheet material located on either the front 14 or back 16 surface of the foam body 12. This configuration is shown in FIGS. 8 and 9. The sentiment panel 17 may be, as shown, shaped in the same way as the foam body 12 and corresponding front 14 and back 16 sheet materials. If the sentiment panel 17 is connected along a fold line to the planar sheet material located on the front surface 14 of the foam body 12, it would serve as an outside front cover and an inside left panel of the greeting card 10. In a closed position, the sentiment panel 17 would be folded over the front surface 14 of the foam body 12 revealing only the outer surface of the sentiment panel 17. In an open position, it would be folded away from and revealing the front surface 14 of the greeting card 10 and the inner surface of the sentiment panel 17. Text sentiment and/or printed photographs or graphics may be contained on both the inside and outside surface of the sentiment panel. If the sentiment panel is connected along a fold line to the planar sheet material located on the back surface 16 of the foam body 12, as is shown in FIG. 9, it would serve as an outside back cover of the greeting card 10 and an inside right panel of the greeting card 10. In a closed position, the sentiment panel 17 would be folded over the back surface 16 of the greeting card 10. In an open position, it would be folded away from the back surface 16 of the greeting card 10 revealing the back surface 16 of the greeting card 10 and the inner surface of the sentiment panel 17. The three-dimensional greeting card 10 may additionally contain a display arm 18 attached to the back surface 16 of the greeting card 10, as shown in FIG. 3. The display arm 18 may be made out of cardboard or other rigid material. The upper portion of the display arm 18 is creased along a fold line 20 so that the display arm 18 may bend outward to function as a support for the greeting card 10, allowing the greeting card 10 to be displayed in a standing position.

Figure 4:
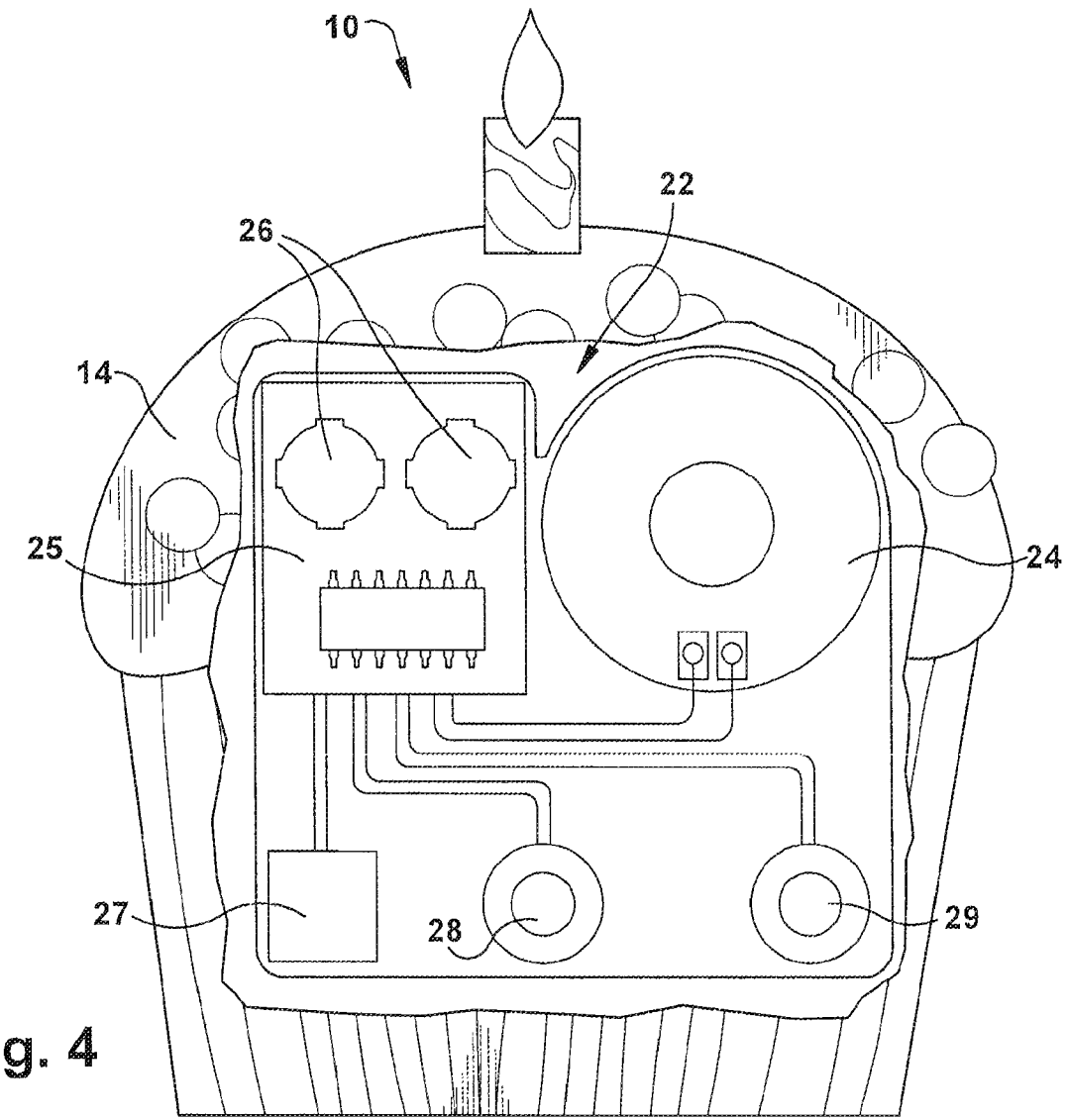
FIG. 4 is a front internal view of the three-dimensional foam greeting card of FIG. 1.

In another embodiment, the foam greeting card, as described above, may contain a sound module 22, as shown in FIG. 4. Components of the sound module may include a circuit board 25, an integrated circuit, a microprocessor, a speaker 24, a memory module, a power source 26, a switch 28, and any other components necessary to trigger and playback a pre-recorded digital audio file. The digital audio file may contain music, singing, a voice message, or any other recordable sound. Components of the sound module 22 may be contained and concealed within a hollowed out portion of the foam body 12. The switch 28 which triggers playback of the audio file may be an electro-mechanical push-button switch 28. This type of switch may be implemented as a press-button 28, wherein each time a user presses the button, playback of the audio file is initiated. A sticker or printed label may be placed above the press-button switch on the outer surface 14 of the greeting card 10 to indicate that this is the area the user must press to playback the audio file. The sticker or printed label may simply say "play" or "press here". Alternatively the surface of the greeting card 10 above the press-button may be printed with words and/or indicators to designate the location of the push-button 28. The switch may alternatively be a mechanical on/off switch which may be located on the front or back surface of the foam greeting card or it may also be located along the perimeter of the foam body 12. A slide trigger switch may also be used to initiate playback of the pre-recorded digital audio file. This type of switch may be particularly used with a foam greeting card having a sentiment panel, as described above, attached to the front or back surface of the greeting card. A slide switch mechanism may be placed over a fold line between the sentiment panel and the foam body such that when the greeting card is opened by moving the sentiment panel away from the foam body, the slide trigger activates the pre-recorded audio. Other switch mechanisms may be used such as light sensitive switches, motion sensitive switches, touch sensitive switches, pressure sensitive switches, thermal switches, moisture or capacitive switches or any other switch which would be known to one skilled in the art.

Figure 1:
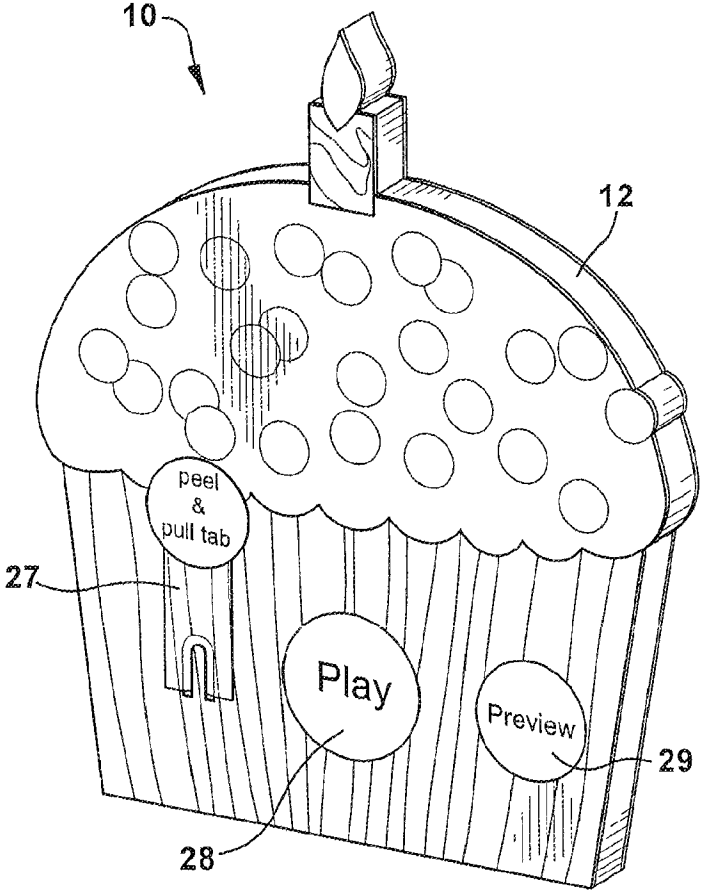
FIG. 1 is a perspective view of a first embodiment of the three-dimensional foam greeting card of the present invention.

In another embodiment, the three-dimensional foam greeting card, as described above, contains both a sound and recording module that provide the user with the ability to record a personalized message to the card recipient. As shown in FIGS. 1 and 4, this embodiment may include at least two electro-mechanical switches 28, 29 to initiate a recording session and a playback session and a microphone. A first switch 28 or "play" button, which may be implemented as a push-button switch as described above, may in a first mode initiate playback of a pre-recorded message instructing the user how to record a personal message and in a second mode initiate playback of the user's personal message. A second switch 29, or "preview" button, which may also be implemented as a push-button, may initiate a recording session wherein the user may record a personal message to the greeting card recipient. A third switch 27 or pull tab is located on the outer surface of the greeting card. This third switch 27 controls whether the greeting card 10 is in a first mode, wherein a user can test the card functionality by recording and previewing the recorded message without the ability to play the message a second time or to hear the message upon pressing the "play" button, or a second mode, wherein the user has purchased the greeting card, and removed the pull tab 27 thereby permitting the user to record a message which is then saved within the sound module and is thereby available for playback upon pressing the "play" button 28. The third switch or pull tab 27 may be located on the outer surface of the greeting card 10 so that is visible to the purchaser. While the pull tab 27 is still intact, pressing the "play" button will initiate playback of a pre-recorded voice message instructing the user how to record a personal message. Once the pull tab 27 has been removed, pressing the "play" button 28 will initiate playback of the user-recorded message. Pressing the "preview" button 29 initiates a recording session, regardless of whether the pull tab 27 has been removed or not. The recording session will continue as long as the user continues pressing or holding down the "preview" button 29 or until the amount of storage allotted for the user-recorded message has been exhausted. Once the user has finished recording the personal message, the personal message will automatically be played back. In the first mode, when the pull tab 27 is still intact, the user-recorded message is played back once and discarded, disabling further playback of the user-recorded message. In the second mode, once the pull tab 27 has been removed, the user-recorded message is immediately played back and saved so that it can be re-played by pressing the "play" button 28. The user may record over a previous message simply by pressing the "preview" button 29 and recording a new message which will overwrite the previously saved user-recorded message. The "preview" button 29 may be indicated on the outer surface of the greeting card by a removable sticker or label. Once the user purchases the greeting card and has recorded a satisfactory message, he/she can remove the "preview" sticker or label before sending the greeting card to the recipient.

Figure 6:
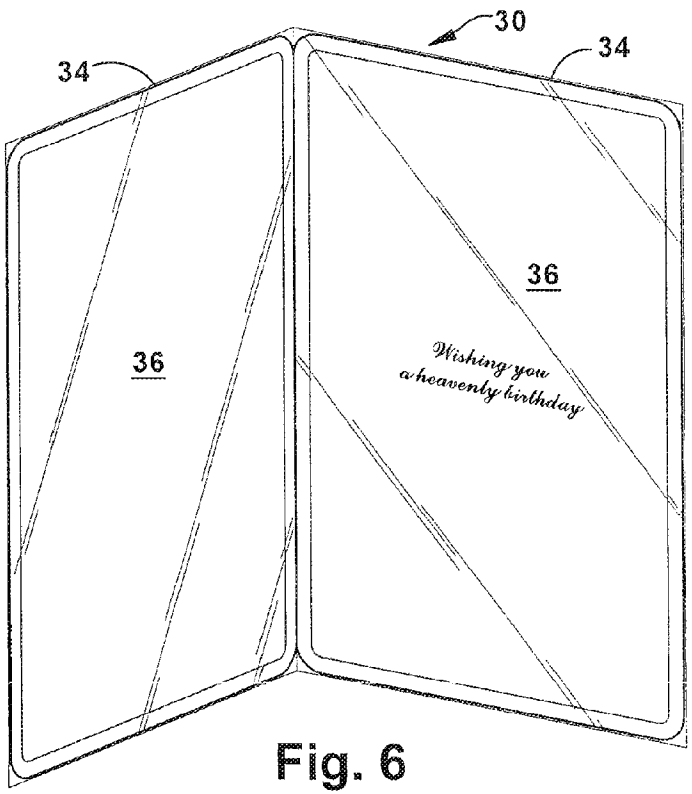
FIG. 6 is a perspective view of the three-dimensional foam greeting card of FIG. 5 in an open position.
Figure 7:
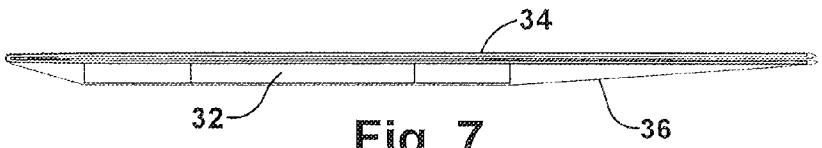
FIG. 7 is a top view of the three-dimensional foam greeting card of FIG. 5 in the direction of arrows 7-7.
Figure 5:
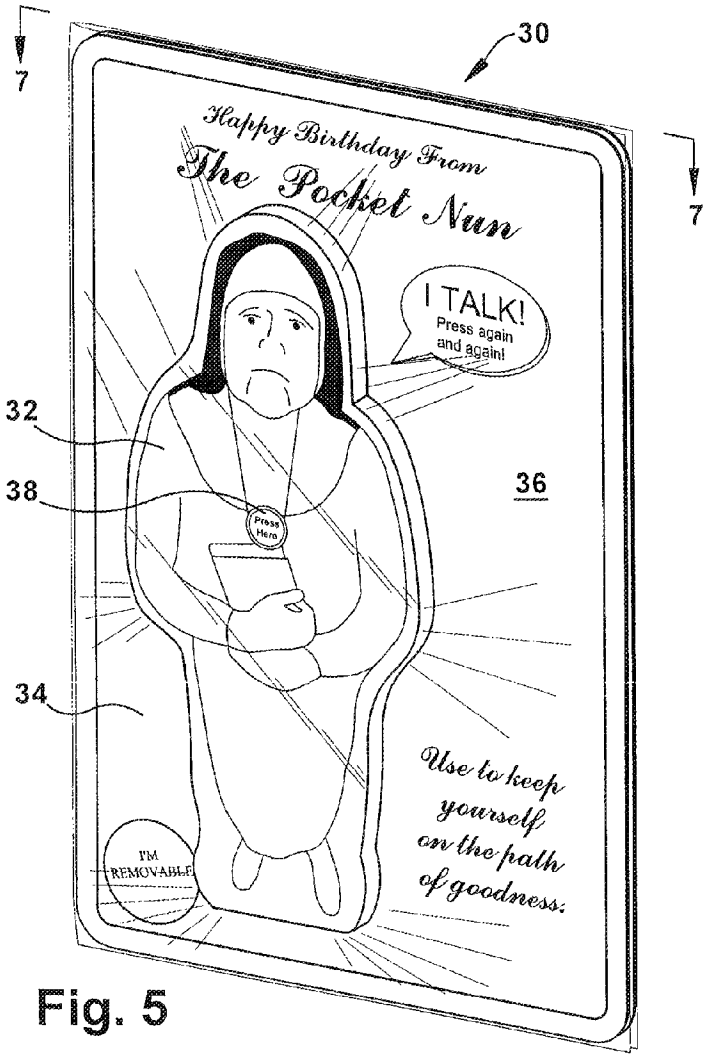
FIG. 5 is a perspective view of an alternate embodiment of the three-dimensional foam greeting card of the present invention in a closed position.

In another form, the three-dimensional foam greeting card of the present invention may be paired with a traditional paper greeting card, such as is shown in FIGS. 5-7. In this embodiment, the removable foam greeting card 32 may serve as a keepsake or token once the paper greeting 34 has been discarded. As shown in FIGS. 5-7, a sealed clear or transparent sleeve 36 made of plastic or other such material is used to pair the separate foam structure 32 and paper greeting card 34 in the same package. The foam structure 32 may be inserted into the sleeve 36 in front of the paper greeting card 34 so it is visible when looking at the greeting card 30 on a greeting card display. Alternatively, the foam structure 32 may be placed on the inside of the paper greeting card 34 to be discovered by the card recipient upon opening the greeting card 30. The foam structure 32 may contain sound, recording, light, motor, multimedia module, or combinations thereof as described in further detail below. As shown in the representative embodiment, the removable foam structure 32 contains a press button 38 which controls activation of an internal sound module, similar to the sound module shown in FIG. 4. Depression of the press button 38 may initiate playback of a pre-loaded audio file containing a voice message, music, sound, or any other digital recording.

Figure 11:
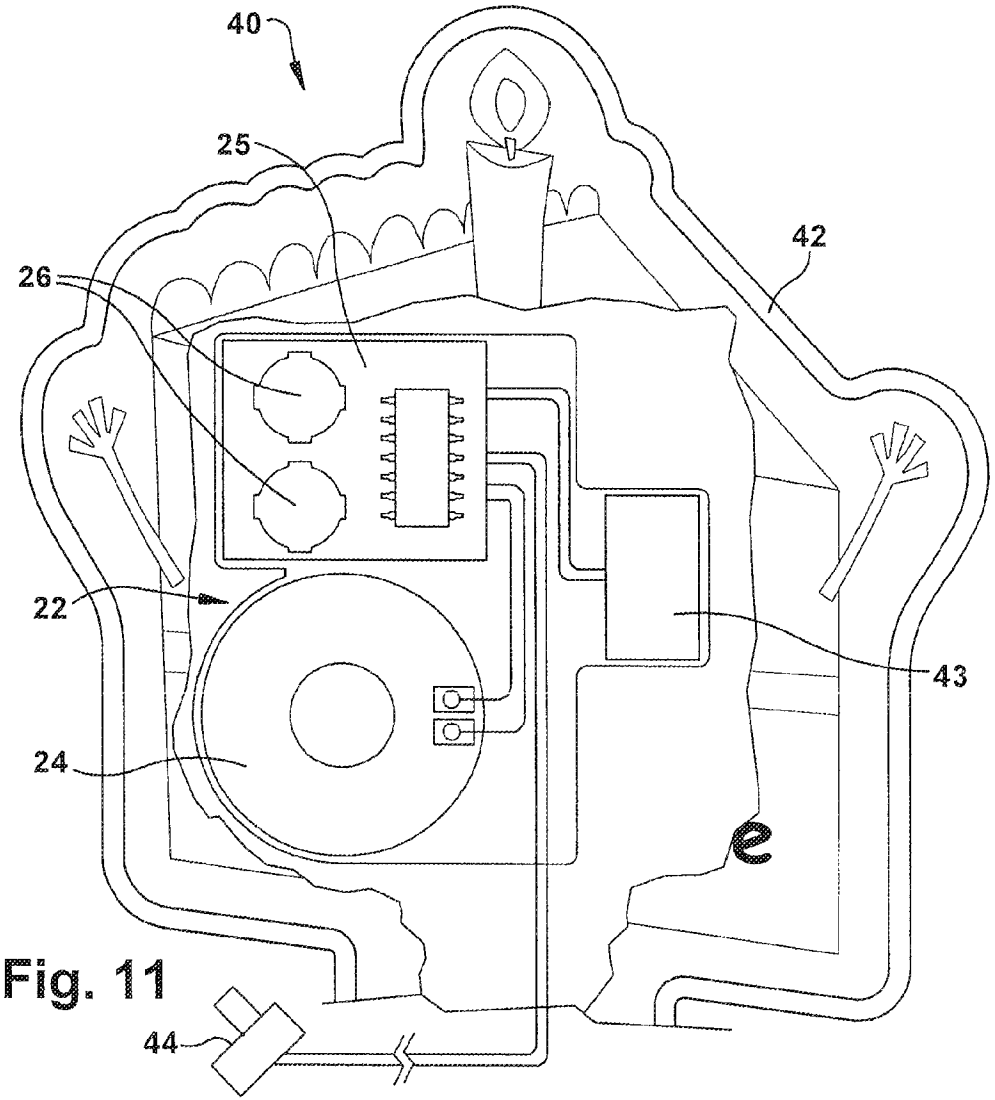
FIG. 11 is an internal view of a portion of the three-dimensional foam greeting card of FIG. 10.
Figure 10:
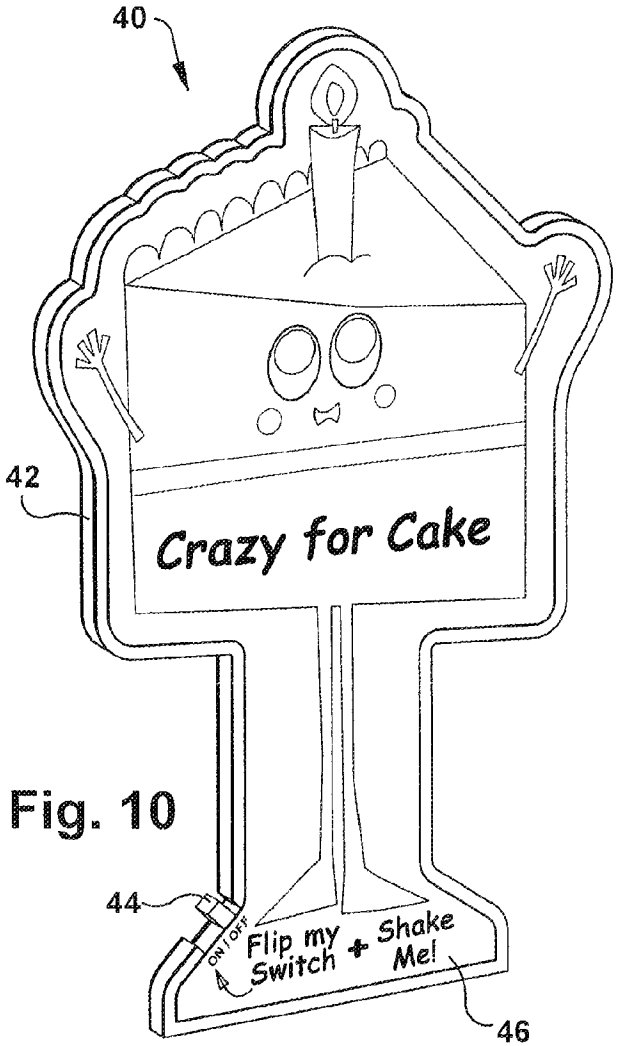
FIG. 10 is a perspective view of an alternate embodiment of the three-dimensional foam greeting card of the present invention.

The three-dimensional foam greeting card with sound, as described above, can additionally contain a motion sensor which operates to trigger one or more pre-loaded audio files. A representative example is shown in FIGS. 10-11. In this embodiment, in additional to the sound module 22 as described above, contains a motion sensor 43 within the cavity in the foam body 42. The motion sensor 43 can be used, in one embodiment, to trigger playback of a first pre-loaded audio file. In another embodiment, a first pre-loaded audio file may be played upon activating a first switch such as a push button switch or toggling a mechanical on/off button 44, as shown in FIGS. 10-11. After the first pre-loaded audio file is played back, movement of the foam body 42 activates the motion sensor 43, which triggers a second pre-loaded audio file. For example, the greeting card 40 may contain instructions to "shake me" 46 so that when the user begins to shake the foam body 42, the motion sensor 43 triggers playback of a pre-loaded audio file.

In another embodiment, the three-dimensional foam greeting card of the present invention may contain a light module with integrated LED lights. The light module would contain A light strand may be stored within a hollowed out portion of the greeting card body between the front and back surfaces of the card. The lights may be programmed to strobe in sequence or blink randomly. Different light colorations may be used as well. Other types of lighting, such as ribbon LED lights may also be used. An electro-mechanical push-activated switch may be used to allow the user to control whether the lights are turned on or off. Also, the lights may be used in combination with pre-recorded sound or a user-recorded message. A single switch may initiate playback of a pre-recorded or user-recorded message as well as turning the lights on or the audio playback and lights may be controlled by different switches.

In yet another embodiment, the three-dimensional foam greeting card of the present invention may contain a motor module located in the hollowed cavity in the foam located between the front and back panels of the greeting card. The motor module causes movement of at least one mobile object associated with the greeting card. The movement may be up and down motion, side to side lateral motion, or any other reciprocating motion. The motor module may contain a rotating gear mechanism that when activated turns a circular gear which is attached at one end to the mobile object. The mobile object can be any three dimensional object which extends outward from the front surface of the greeting card body. Activation of the motor module, which can be by a push button switch, slide switch, or any other switching mechanism, causes movement of the mobile object. Other novelties may be attached to the outside surface of the foam body such as moving eyes or other decorative embellishments.

Figure 13:
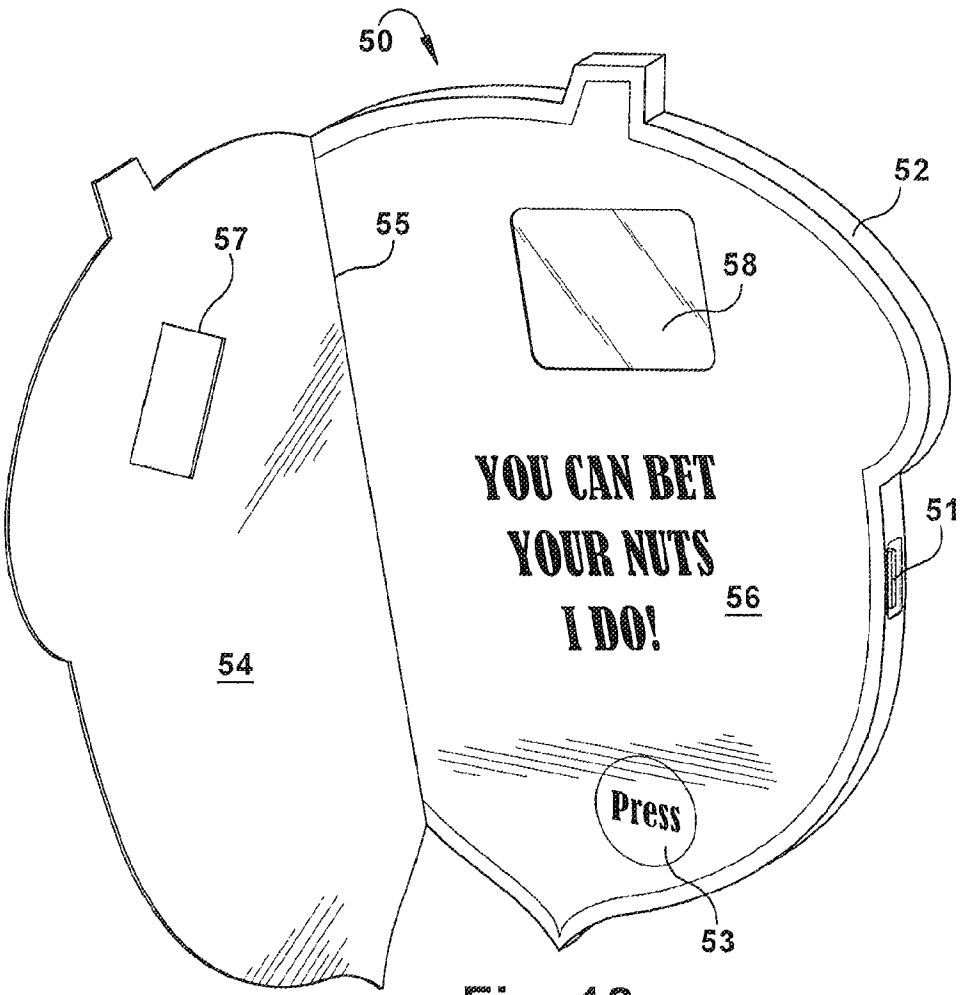
FIG. 13 is a perspective inside view of the three-dimensional foam greeting card of FIG. 12 in an open position.
Figure 12:
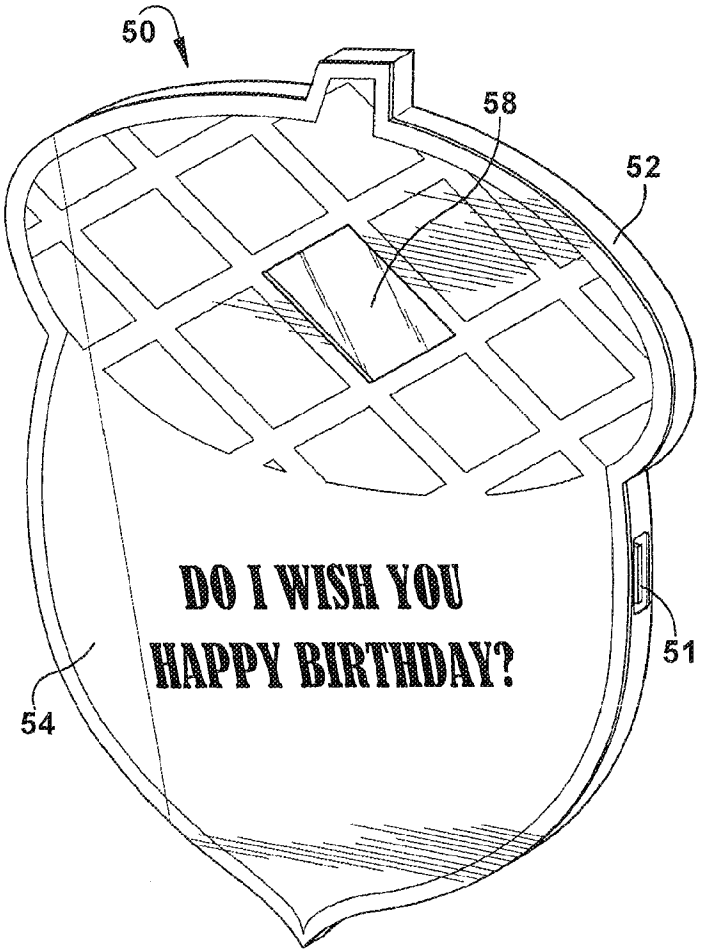
FIG. 12 is a perspective view of an alternate embodiment of the three-dimensional foam greeting card of the present invention in a closed position.

In still another embodiment, the three-dimensional foam greeting card of the present invention may be operative to play pre-loaded video and/or audio recordings. In this embodiment, a representative example of which is shown in FIGS. 12 and 13, a multimedia player device is contained within the hollowed cavity in the foam body 52 located between the front and back panels of the greeting card 50. The multimedia player device may be capable of displaying pre-loaded images or video and emitting sound. Components of such multimedia player device may include, but are not limited to, a flat panel display screen 58, such as an LCD screen, a power source which preferably consists of one or more disposable batteries, an audio speaker, integrated circuit, a circuit board with microprocessor, a data storage device and related circuitry. The device may contain at least one pre-recorded slideshow with accompanying pre-recorded digital audio files. A representative device may store up to approximately 20 pre-loaded photos or images and between approximately 26 seconds to 2.26 minutes of audio or greater, depending on the amount of digital storage provided. The device, when powered by four disposable lithium batteries, is capable of playing the pre-loaded audio/visual content approximately 300 times. Representative width and/or height dimensions of a display screen 58 are between approximately 1.5 and 2.4 inches. The screen 58 may be visible through an opening in the planar sheet material located on the front surface 56 of the foam body 52. The foam greeting card body 52 may additionally contain a sentiment panel 54, as described above, which is attached along a fold line 55 to the planar sheet material attached to the front surface 56 of the foam body 52. The sentiment panel 54 would serve as the front cover of the greeting card 50 and in a closed position, lay atop the sheet material attached to the front surface 56 of the foam body 52. The sentiment panel 54 may also contain an opening thereon 57, consistent with the opening for the display screen 58 contained on the planar sheet material located on the front surface 56 of the foam body 52, through which the display screen 58, contained within the foam body 52, is visible. The multimedia display device may be activated by a push button switch 53 located on the front or back surface of the foam body 52. The greeting card 50 may contain the words "play" printed above the push button switch 53 which indicates where the multimedia player device is activated. Alternatively, the greeting card 50 may contain a slide switch which is used in combination with a sentiment panel 57, as described above. The slide switch may be located across a fold line 55 between the sentiment panel 54 and the foam greeting card body 52, such that when the greeting card 50 is opened or the sentiment panel 54 is folded away from the greeting card body 52, the slide switch works to activate the multimedia player. The greeting card 50 may additionally contain a mechanical on/off switch or button which controls whether or not the multimedia player device may be activated. The on/off switch may be located along the side perimeter of the foam body 52 between the planar sheet material located on the front and back surfaces of the foam body or it may be located on the front or back surface of the greeting card body.

A further embodiment of the three dimensional foam greeting card with multimedia player device, as described directly above, may contain audio recording capabilities which would provide a user with the ability to record a personalized message to be played before, during or after the pre-recorded slideshow is displayed on the display screen. Additional components such as a sound and recording module, as described above with reference to a previous embodiment, would accompany the multimedia player device within the cavity located within the foam body between the front and back panels of the greeting card. The multimedia player device may contain one or more pre-recorded audio files that may be played before during or after the personalized user recorded message.

Further still, the three dimensional foam greeting card with multimedia player device may additionally include a USB port 51, SD slot or any other appropriate external memory input source so that a user may upload digital video, digital photos and/or digital audio files to be presented on activation of the multimedia device. The multimedia device may be capable of playing several file formats including, but not limited to, flash, html, html5, mp3, mp4, .mov, .rp4, /wma, etc. The multimedia player device may also contain one or more pre-loaded digital video, photo and/or audio files which may be played in combination with the user uploaded digital video, photo and/or audio. The video, slideshow and/or audio may be triggered by any of the switch mechanisms described herein and playback may further be controlled by a mechanical on/off switch. The switch mechanisms may be located on the front or back of the greeting card or along the side perimeter of the foam structure.

The three-dimensional foam greeting cards of the present invention may also contain a battery-saving device which includes a small substantially rectangular plastic insert which is inserted into a small slot in the foam body. The slot is located directly outside the location of a battery circuit switch which is contained on the circuit board inside the foam body. When the device is inserted into the slot the circuit is opened, preventing batteries from draining while the product is not in use. When the device is removed, the circuit closes, and the batteries are activated, allowing the user to record a message, play an audio clip, light up the greeting card or cause components of the greeting card to be put in motion.

Figure 14:
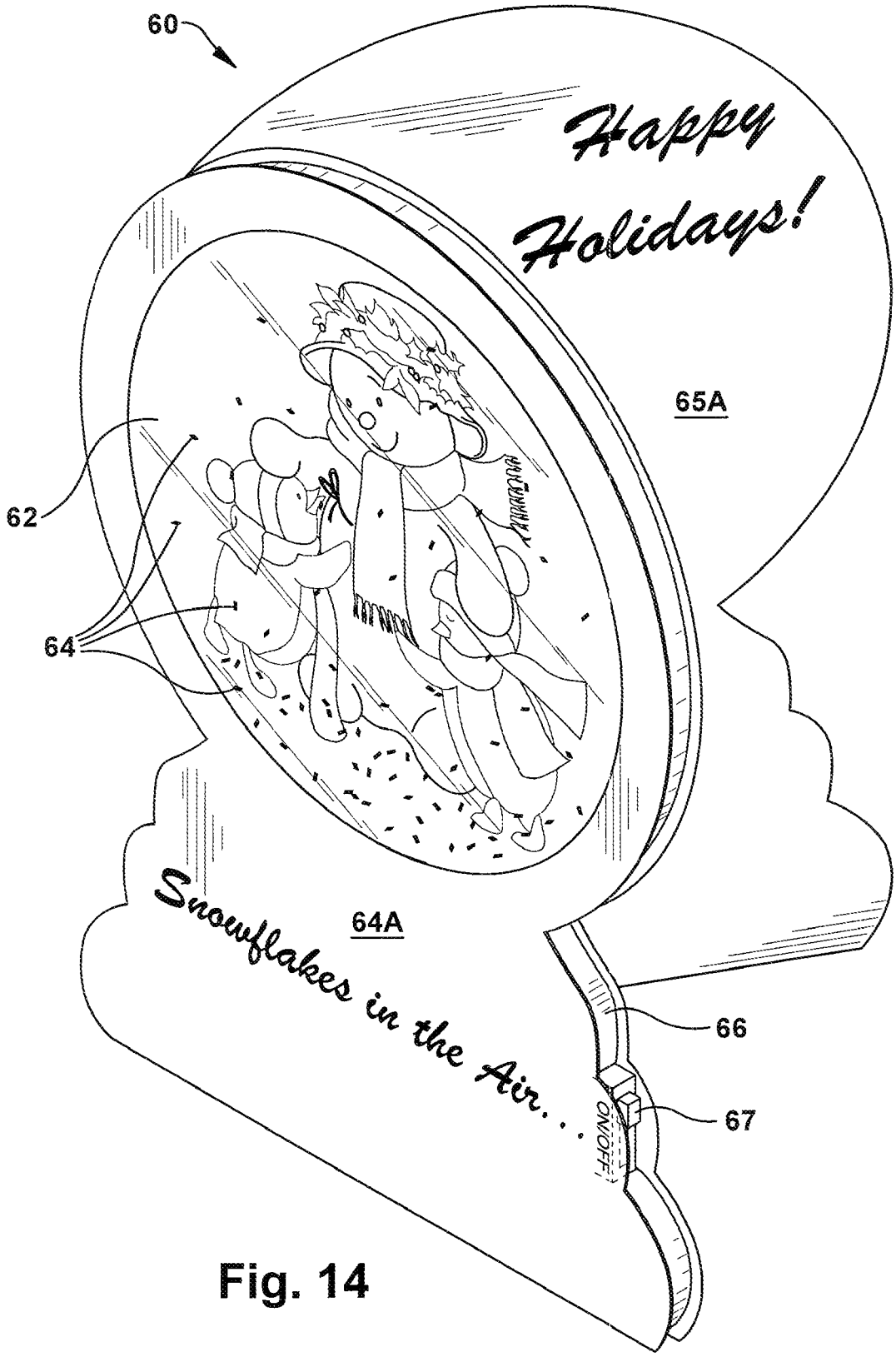
FIG. 14 is a perspective view of an alternate embodiment of the three-dimensional foam greeting card of the present invention.
Figure 15:
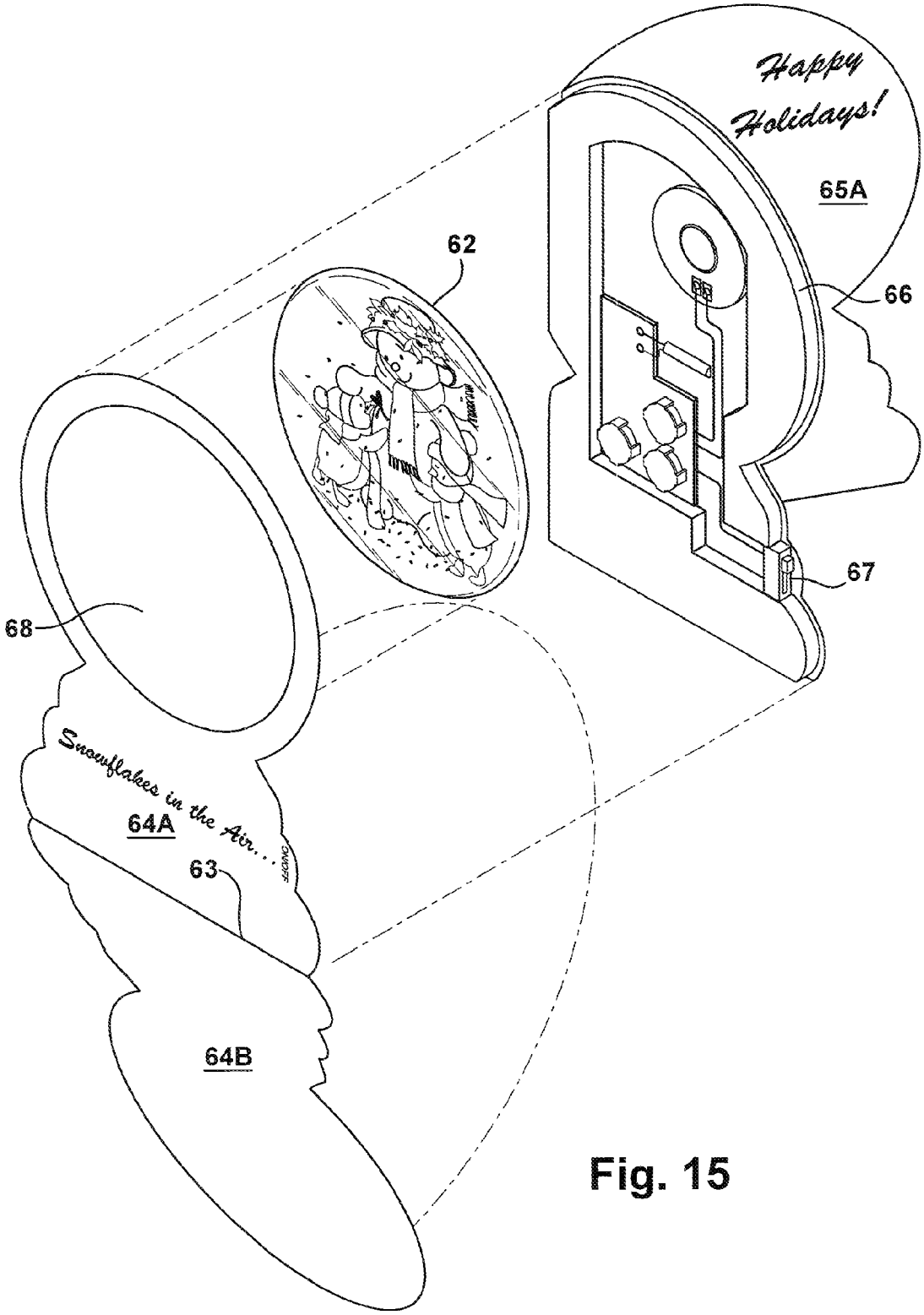
FIG. 15 is an exploded view of the foam greeting card of FIG. 14.
Figure 17:
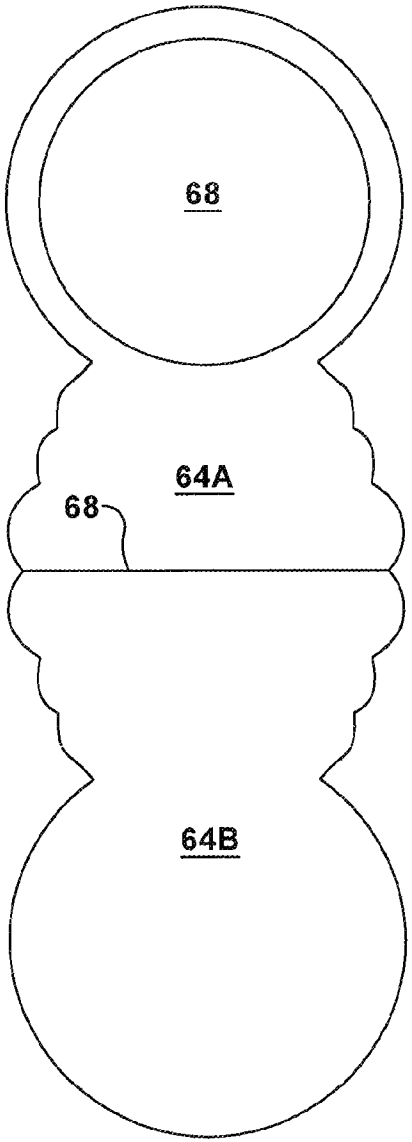
FIG. 17 is a front view of the mirror-image rear panels of the greeting card of FIG. 14.
Figure 16:
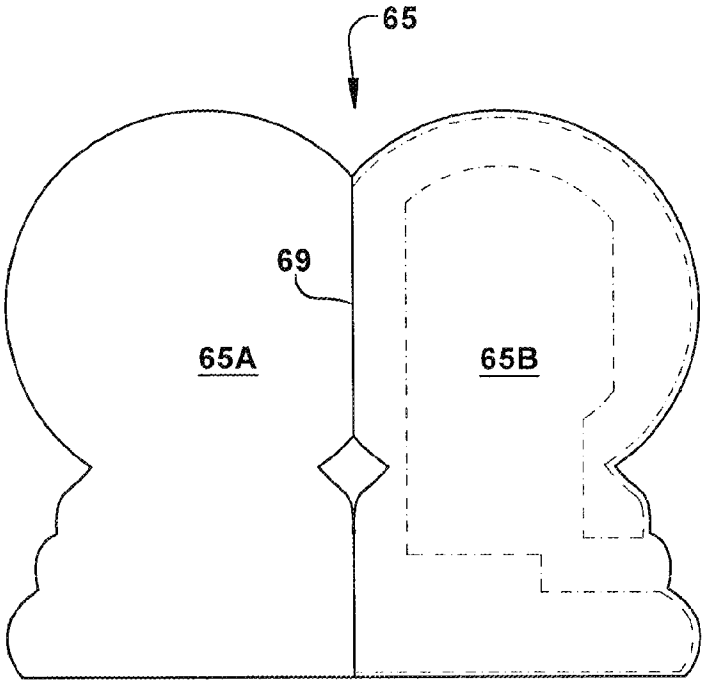
FIG. 16 is a front view of the mirror-image front panels of the greeting card of FIG. 14.

In another embodiment, shown in FIG. 14, the three-dimensional foam greeting card 60 additionally includes a soft bladder 62 or other enclosure which is filled with a plurality of small particles 64 which are suspended in a liquid substance to simulate a snow globe. The soft bladder 62 or enclosure is attached, either directly or indirectly, to a surface of the foam greeting card body 66, such as the front surface. The bladder 62 is a water-tight container which may be made of plastic or other lightweight transparent material. It may be of any shape or form but in a preferred embodiment, with be shaped to conform to at least a portion of the foam greeting card body 66 and front 64 and back 65 surface materials. The plurality of small particles 64 contained within the liquid substance inside of the bladder 62 may be glitter, or small cut-outs or confetti-like pieces, or other non-buoyant particles (with respect to the liquid substance), or a combination thereof. The confetti-like particles may be die cut into a variety of shapes. Each particle may be of the same shape or the plurality of particles 64 may contain many different shapes. The plurality of particles 64 may be semi-transparent or iridescent, may be of a single color or may contain multiple colors. The particles 64 may be a combination of confetti-like particles and glitter. The plurality of particles 64 are suspended in a liquid substance so that when the bladder 62 is moved or shaken, the particles 64 appear to be floating or slowly moving through the liquid substance. For example, the plurality of particles 64 may be die cut to resemble snow flakes such that when the bladder 62 is shaken, the greeting card 60 has the visual effect of snow falling. The liquid substance may be clear or transparent or may be a colored liquid through which the plurality of particles 64 is visible. The speed at which the particles 64 move through the liquid substance may vary by adjusting the specific weight of the liquid substance and/or the plurality of particles 64. The bladder 62 may be positioned and secured between two or more pieces of planar sheet material. In a preferred embodiment, the bladder 62 is positioned between two panels of planar sheet material 64A, 64B which are attached along a fold line 63 located across a bottom edge of the two panels 64A, 64B, as shown in FIGS. 15 and 17. The front panel 64A and back panel 64B are mirror images of each other. The back panel 64B is attached to the foam body 66. The bladder 62 is secured between the front 64A and back panels 64B. The back panel 64B is folded in an upward direction along fold line 63 and secured to the front panel 64A. The front panel 64A contains an opening or aperture 68 thereon through which the bladder 62 is visible. A portion of the front panel 64A frames the outer edges of the bladder 62. In a preferred embodiment, the front 64A and back 64B panels are shaped substantially similar to the foam body 66. For example, as shown in FIG. 15, the bladder 62 has a circular shape to resemble a typical snow globe. The opening or aperture 68 in the front panel 64A is also circular shaped creating a circular frame about the edges of the bladder 62. Alternatively, the opening or aperture 68 in the front panel 64A through which the bladder 62 is visible may be of a different shape than the bladder 62 and may reveal a portion or substantial portion of the bladder 62 therethrough. Alternatively, in place of the back panel 64B, the bladder 62 may be positioned directly between the front panel 64A and the foam body 66. The foam body 66 may be formed in various shapes and sizes. A portion of the foam body 66 is sunken-in or recessed to create a cavity into which electronic and other related components may be inserted. Once the electronic and other related components are inserted into the cavity, they are concealed by the front panel 64 of the greeting card, which gets attached to the front surface of the foam body 66. The electronic components may be operative to store and produce sound, activate lights, or perform other such special effects. The components may include a circuit board, a controller, a memory storage unit, a power source such as disposable batteries, a speaker, a switch and any other components which are necessary for storing and producing sound, light, or performing any such special effects and which are known to one having skill in the art. The back surface of the foam body 66 is optionally covered by a greeting panel 65. The greeting panel 65 is shaped the same as or substantially similar to the foam body 66. The greeting panel 65 includes a right greeting panel 65A and a left greeting panel 65B which are connected along a vertical fold line 69, as shown in FIG. 16. The left 65A and right 65B greeting panels are folded about the fold line 69 to overlap one another, thereby creating a typical two-panel greeting card. The left greeting panel 65A is attached to the back surface of the foam body 66 and the inside surface of the right 65A and left 65B greeting card panels can contain a greeting, such as text sentiment, and other printed indicia, as is typical in a classic greeting card. The back surface of the right greeting panel 65B serves as the back of the entire foam greeting card 60. This snow globe embodiment may additionally contain a sound module that is contained within a recess in the foam body, as described above, a mechanical on/off switch 67 located along the perimeter of the foam body 66, and a motion sensor which operates to trigger the replay of one or more pre-loaded digital audio files which are contained in memory within a sound module. When the mechanical on/off switch 67 is positioned in the "on" position, a user or recipient may "shake" the greeting card or simulated snow globe to trigger playback of a digital audio file, such as a Christmas song, spoken greeting, or other digital recording. This prevents the greeting card from producing sound whenever it is moved from place to place, or when being mailed to a recipient. The shaking motion both triggers the audio playback and shuffles the plurality of particles within the liquid substance located in the bladder. The greeting card may contain instructions to "shake me" on a removable sticker or other printed indicia. For example, the greeting card may be a Christmas card, which is shaped and decorated like a snow globe, as is shown in the figures. When a user turns the on/off switch into the "on" position and shakes the greeting card, it sets the plurality of particles 64 in motion within the liquid inside the bladder 62, and the motion sensor initiates playback of the audio file, which may be a Christmas carol.

Figure 18:
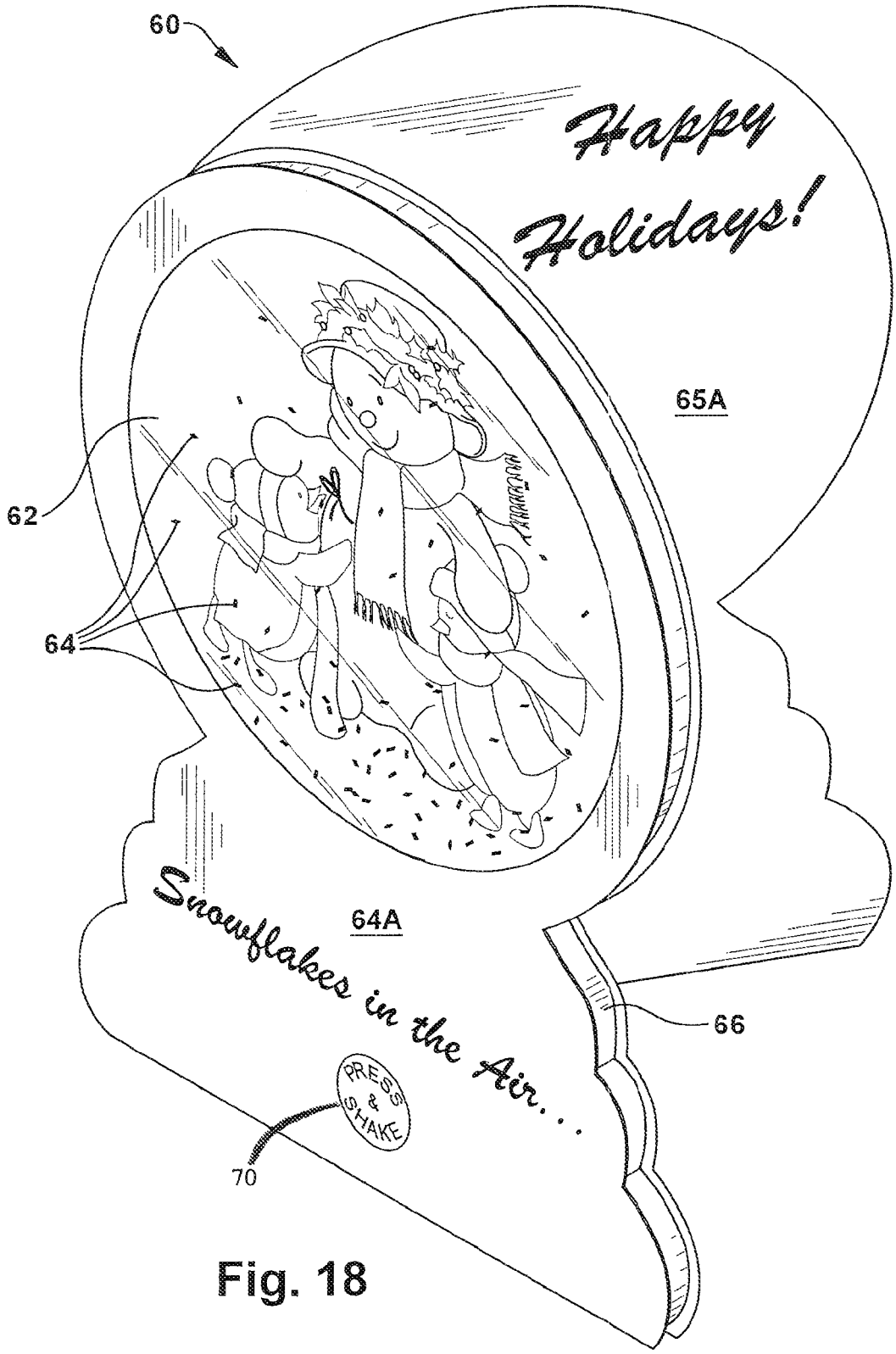
FIG. 18 is a perspective view of an alternate embodiment of the three-dimensional foam greeting card of the present invention.

In a variation of the greeting card described directly above and shown in FIGS. 14 through 17, the greeting card may contain a push button switch, which in a preferred embodiment, may be accessed through the front face of the greeting card. This embodiment is shown in FIG. 18. Instead of an on/off switch and motion sensor controlling playback of prerecorded audio, this embodiment contains a single push button switch 70 which activates playback of one or more prerecorded audio files, which are stored in memory within the sound module. A user may simply press the push button 70 at the location indicated (by sticker or by printed indicia) on the greeting card. The push button 70 activates audio playback. Shaking the greeting card will set the plurality of particles 64 in motion within the liquid in side the bladder 62 but does not control audio playback.

The foam snow globe embodiments of the present invention may additionally be combined with any one or more of the alternate embodiments described above. This embodiment may contain other features, as described above, including but not limited to: a sentiment panel, a display arm, a recording module to allow a user to record and save a personalized messaged to be replayed to the greeting card recipient, a light module, a motor module, a multimedia player device, or any other feature as described herein.

It should be noted that the three-dimensional foam greeting card described herein may contain one or a combination of two or more functions, as described, such as sound, light, audio, recording, motion, or multimedia functions. Additionally, a variety of switches are mentioned herein and can be used alone or in combination and may be located in a variety of locations on the three-dimensional foam greeting card.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A foam greeting card comprising:

a three-dimensional foam body;

a planar surface material;

a bladder made from a transparent material containing a liquid substance and a plurality of particles, the bladder located between the three-dimensional foam body and the planar surface material;

a mechanical on/off switch located along the perimeter of the three-dimensional foam body;

a sound module contained and concealed within the three-dimensional foam body;

a motion sensor operative to initiate playback of at least one digital audio file contained within the sound module;

wherein the bladder is visible through an aperture in the planar surface material, and, wherein when the mechanical on/off switch is placed in the "on" position and the greeting card is shaken or moved in an up and down or back-and-forth motion, the motion sensor triggers playback of the at least one digital audio file.

2. The foam greeting card of claim 1, wherein the plurality of particles include glitter.

3. The foam greeting card of claim 1, wherein the plurality of particles includes confetti.

4. The foam greeting card of claim 1 further comprising a second planar surface material which is attached to the back of the three-dimensional foam body.

5. The foam greeting card of claim 4, wherein the second planar surface material includes two panels which are attached along a vertical fold line.

6. The foam greeting card of claim 1, wherein the planar surface material is die cut to resemble the shape of the three-dimensional foam body.

7. The foam greeting card of claim 1, wherein the planar surface material includes two panels which are attached along a horizontal fold line at a bottom edge of the panels, the bladder being located between the two panels of the planar surface material.

8. A foam greeting card comprising:

a three-dimensional foam body;

a sound module operative to store and play at least one pre-loaded digital audio file, the sound module located within a cavity in the three-dimensional foam body;

a back planar surface material having two panels attached along a vertical fold line, one panel being attached to a back surface of the three-dimensional foam body;

a front planar surface material having two panels attached along a horizontal fold line along a bottom edge of the two panels, one of the panels being attached to a front surface of the three-dimensional foam body and the other panel having an opening thereon;

a bladder containing a liquid and a plurality of particles freely floating within the liquid, the bladder located between the two panels of the front planar surface material and visible through the opening on one of the two panels;

a switch which is operative to trigger playback of the at least one digital audio file.

9. The foam greeting card of claim 8, wherein the switch is a motion sensor switch.

10. The foam greeting card of claim 9 further comprising a second switch which is a mechanical on/off switch, operative to control power to the motion sensor switch.

11. The foam greeting card of claim 9, wherein movement of the greeting card activates the motion sensor switch.

12. The foam greeting card of claim 8, wherein the switch is a press-button switch.

13. The foam greeting card of claim 8, wherein the bladder is made of a transparent material.

14. The foam greeting card of claim 8, wherein the liquid is transparent.

15. The foam greeting card of claim 8, wherein the front planar surface and the back planar surface are die cut into the shape of the three-dimensional foam body.

16. A foam greeting card comprising:

a three-dimensional foam body having a cavity contained therein;

a sound module contained within the cavity in the three-dimensional foam body, the sound module comprising a printed circuit board, a microprocessor, a memory unit, a speaker, a power source and at least one digital audio file contained on the memory unit;

a clear bladder attached to a front surface of the three-dimensional foam body, the clear bladder containing a liquid substance and a plurality of particles;

a press-button switch operative to control playback of at least one digital audio file contained within the sound module;

a two-panel greeting card is attached to the back surface of the three-dimensional foam body;

wherein when the greeting card is shaken, the plurality of particles move around within the liquid substance.

17. The foam greeting card of claim 16, wherein the plurality of particles include glitter.

18. The foam greeting card of claim 16, wherein a planar surface material is placed over the front surface of the three-dimensional foam body, the planar surface material having an opening thereon through which the bladder is visible.

19. The foam greeting card of claim 16, wherein the press-button switch is accessed through the front surface of the greeting card.

* * * * *